US009683565B2

(12) United States Patent
Bredenfeld et al.

(10) Patent No.: US 9,683,565 B2
(45) Date of Patent: Jun. 20, 2017

(54) GEAR MACHINE WITH ECCENTRICITY AT THE GEARWHEELS

(71) Applicant: Robert Bosch GmbH, Stuttgart (DE)

(72) Inventors: Guido Bredenfeld, Marbach (DE); Markus Stahl, Schwarzenbruck (DE); Christoph Cholewa, Cadolzburg (DE)

(73) Assignee: Robert Bosch GmbH, Stuttgart (DE)

( * ) Notice: Subject to any disclaimer, the term of this patent is extended or adjusted under 35 U.S.C. 154(b) by 98 days.

(21) Appl. No.: 14/699,397

(22) Filed: Apr. 29, 2015

(65) Prior Publication Data

US 2015/0308428 A1 Oct. 29, 2015

(30) Foreign Application Priority Data

Apr. 29, 2014 (DE) ..... 10 2014 208 021

(51) Int. Cl.
*F03C 2/00* (2006.01)
*F03C 4/00* (2006.01)
(Continued)

(52) U.S. Cl.
CPC ..... *F04C 2/084* (2013.01); *F04C 2/086* (2013.01); *F04C 2/18* (2013.01); *F04C 15/0026* (2013.01);
(Continued)

(58) Field of Classification Search
CPC .. F04C 2/18; F04C 2/086; F04C 2/084; F04C 15/0065; F04C 18/082; F04C 18/084;
(Continued)

(56) References Cited

U.S. PATENT DOCUMENTS 2,817,297 A * 12/1957 Mosbacher ..... F04C 15/0026 418/132
2,881,704 A 4/1959 Murray
(Continued)

FOREIGN PATENT DOCUMENTS

DE 10 2012 206 699 A1 10/2013
DE 10 2012 209 775 A1 12/2013

OTHER PUBLICATIONS

German Search Report corresponding to German Application No. 10 2014 208 021.5; mailed Nov. 18, 2014; 7 pages; München, Germany.

*Primary Examiner* — Theresa Trieu
(74) *Attorney, Agent, or Firm* — Maginot, Moore & Shohl LLP

(57) ABSTRACT

A gear machine comprises a housing, at least two gearwheels positioned within the housing, and a bearing body defining a circular-cylindrical outer surface segment and a bearing bore. The at least two gearwheels configured to mesh in external engagement with each other. At least one of the gearwheels includes at least one bearing journal rotatably positioned within the bearing bore. The bearing body is positioned within the housing with the circular-cylindrical outer surface segment engaging a corresponding bearing surface defined on the inside of the housing. Each of the at least two gearwheels includes a plurality of tooth tips configured to engage a corresponding sealing surface defined on the inside of the housing. At least one segment of at least one of the sealing surface and the bearing bore is eccentric with respect to the circular-cylindrical outer surface segment of the bearing body. A method of production is also provided.

18 Claims, 3 Drawing Sheets

(51) Int. Cl.

| | |
|---|---|
| ***F04C 2/00*** | (2006.01) |
| ***F04C 2/08*** | (2006.01) |
| ***F04C 15/00*** | (2006.01) |
| ***F04C 18/08*** | (2006.01) |
| ***F04C 2/18*** | (2006.01) |

(52) U.S. Cl.
CPC ..... *F04C 15/0065* (2013.01); *F04C 18/082* (2013.01); *F04C 2230/602* (2013.01); *F04C 2240/50* (2013.01); *F04C 2240/56* (2013.01)

(58) Field of Classification Search
CPC ..... F04C 15/0023; F04C 15/0026; F04C 2240/50; F04C 2240/56
USPC ..... 418/1, 104, 132, 150, 206.1–206.9
See application file for complete search history.

(56) References Cited

U.S. PATENT DOCUMENTS 3,137,238 A * 6/1964 Gordon ..... F04C 15/0026 418/132
5,052,905 A * 10/1991 Rustige ..... F04C 15/0026 418/132
5,417,556 A * 5/1995 Waddleton ..... F04C 15/0026 418/132

* cited by examiner

GEAR MACHINE WITH ECCENTRICITY AT THE GEARWHEELS

This application claims priority under 35 U.S.C. §119 to patent application no. DE 10 2014 208 021.5, filed on Apr. 29, 2015 in Germany, the disclosure of which is incorporated herein by reference in its entirety.

The disclosure relates to a gear machine.

BACKGROUND

A gear machine comprises two gearwheels, which mesh with one another in external engagement, wherein they are surrounded by a housing. The housing is preferably provided with a high pressure port and a low pressure port. When the gear machine is operated as a pump, a rotary motion is imparted to the gearwheels, e.g. by means of an electric motor, and hydraulic fluid, in particular hydraulic oil, flows from the low pressure port to the high pressure port. When the gear machine is operated as a motor, hydraulic fluid flows from the high pressure port to the low pressure port, and a rotary motion is imparted to the gearwheels. One gearwheel is preferably provided with a drive journal, which projects from the housing.

A corresponding gear machine is known from DE 10 2012 206 699 A1. At least one gearwheel has a bearing journal, which is accommodated rotatably in an associated bearing bore. The bearing bore is arranged in a separate bearing body, which has a circular-cylindrical outer surface segment, which is associated with the gearwheel and by means of which it rests on an associated bearing surface on the inside of the housing. Opposite the tooth tips of the gearwheels there is furthermore a sealing surface, which is arranged on the inside of the housing.

Typically, the outer surface segment, the bearing surface and the sealing surface are of circular-cylindrical design, wherein the bearing surface and the sealing surface are arranged so as to be flush. During operation of the gear machine, the aim is that at least one tooth tip of each gearwheel should rest on the associated sealing surface in each rotational position of the gearwheels. This is typically achieved by means of a run-in operation, in which the gear machine is filled with pressurized fluid, in particular hydraulic oil, being operated with the maximum permissible operating pressure. During this process, material is removed by the tooth tips of the gearwheels from the associated sealing surface, giving rise to a clearly visible run-in trace. The run-in operation is complete when no more removal of material takes place.

The removal of material and hence the duration of the run-in process are dependent on the precise dimensions of the diameter of the bearing journal, the bearing bore, the outer surface segment, the bearing surface and the sealing surface. Said diameters can only be produced with a tolerance that differs from zero. The removal of material or run-in depth is furthermore dependent on the elastic deformation caused by the pressure forces of the pressurized fluid on the gear machine.

SUMMARY

An advantage of a gear machine according to the disclosure is that the removal of material during the run-in process and hence the duration of running in are minimized.

According to one embodiment, the sealing surface and/or the bearing bore are arranged eccentrically with respect to the associated outer surface segment of the bearing body, at least in some segment or segments. Accordingly, some of the removal of material during the subsequent run-in process is already anticipated during the production of the individual parts. The bearing surface is preferably of circular-cylindrical design. The bearing journal is preferably accommodated with play in the associated bearing bore. The bearing bore is preferably formed in a separate bearing sleeve, which, as a particularly preferred option, is press fitted into the remainder of the bearing body.

According to another embodiment, a run-in operation is carried out, in which the gear machine is filled with pressurized fluid, wherein it is operated at a predetermined operating pressure of the pressurized fluid, wherein the eccentricity selected is such that removal of material takes place at the sealing surface during the run-in operation. During the run-in operation, therefore, there is always removal of material, and therefore virtually ideal matching of the tooth tips to the sealing surface is ensured. The removal of material preferably takes place only in one part of the sealing surface, most particularly preferably in the second segment explained below.

In one embodiment, the sealing surface has a first segment, which is flush with the associated bearing surface, wherein the sealing surface has a second segment, which is of circular-cylindrical design, wherein the second segment is arranged eccentrically with respect to the bearing surface. The bearing surface is preferably of circular-cylindrical design. With this embodiment, the primary effect is to avoid removal of material during the run-in process caused by elastic deformation of the gear machine during operation. However, it is also conceivable to minimize the removal of material caused by production tolerances. For this purpose, the gear machine, in particular the abovementioned diameters, is/are preferably measured, with the eccentricity being selected in accordance with the corresponding measurement result.

In another embodiment, a first and a second gearwheel are provided, with which a first and a second sealing surface are associated, wherein the second segments of the first and of the second sealing surface have different diameters from one another and/or different eccentricities from one another. It is thereby possible to achieve a particularly short run-in operation.

In some embodiments, the bearing bore is of circular-cylindrical design over the entire circumference thereof, wherein it is arranged eccentrically with respect to the associated outer surface segment of the bearing body. With this embodiment, the intention is, in particular, to minimize removal of material during the production process attributable to the production tolerances of the individual parts of the gear machine. The particular advantage of this embodiment is that said eccentricity can be produced without the need for measurement of the individual parts of the gear machine. For the details, attention is drawn to the following explanations. The embodiments according to dependent claims 2 and 4 can be combined with one another in order to achieve a particularly short run-in operation. If this is not desired, it is preferred that the sealing surface and the bearing surface are of circular-cylindrical design, wherein they are arranged so as to be flush.

In other embodiments, the eccentricity selected is such that the axis of rotation of the associated gearwheel is substantially centric with respect to the bearing surface during the operation of the gear machine. Under these circumstances, the least possible removal of material takes place at the sealing surface during the run-in process.

According to an embodiment, the selected direction of the eccentricity is parallel to the direction of the force which the pressurized fluid exerts on the associated gearwheel during operation. A particularly short run-in operation is then obtained.

In a particular embodiment, the gear machine has a first and a second gearwheel, which are arranged symmetrically in relation to a plane of symmetry, wherein the direction of the eccentricity is at an angle of between 15° and 45°, preferably at an angle of 30°, to the plane of symmetry. The direction of the force which the pressurized fluid exerts on the associated gearwheel during operation is typically at the angle stated.

Some embodiments specify that the bearing bore is produced first on the bearing body, wherein the outer surface segment is then produced, wherein, during the production of the outer surface segment, the bearing body is mounted on a mandrel, which engages in the bearing bore. A production tolerance of the bearing bore can thereby be compensated already during the production of the outer surface segment. As a result, the bearing bore is arranged eccentrically with respect to the outer surface segment. The mandrel preferably has the nominal diameter of the bearing journal.

In a particular embodiment, during the production of the outer surface segment, the bearing body is clamped against the mandrel in the direction of the force which the pressurized fluid exerts on the gearwheels during the operation of the gear machine. The compensation of the production tolerance of the bearing bore is particularly good in this case.

It is self-evident that the features mentioned above and those which will be explained below can be used not only in the respectively indicated combination but also in other combinations or in isolation without exceeding the scope of the present disclosure.

BRIEF DESCRIPTION OF THE DRAWINGS

The disclosure is explained in greater detail below with reference to the attached drawings, in which.

DETAILED DESCRIPTION

Figure 1:
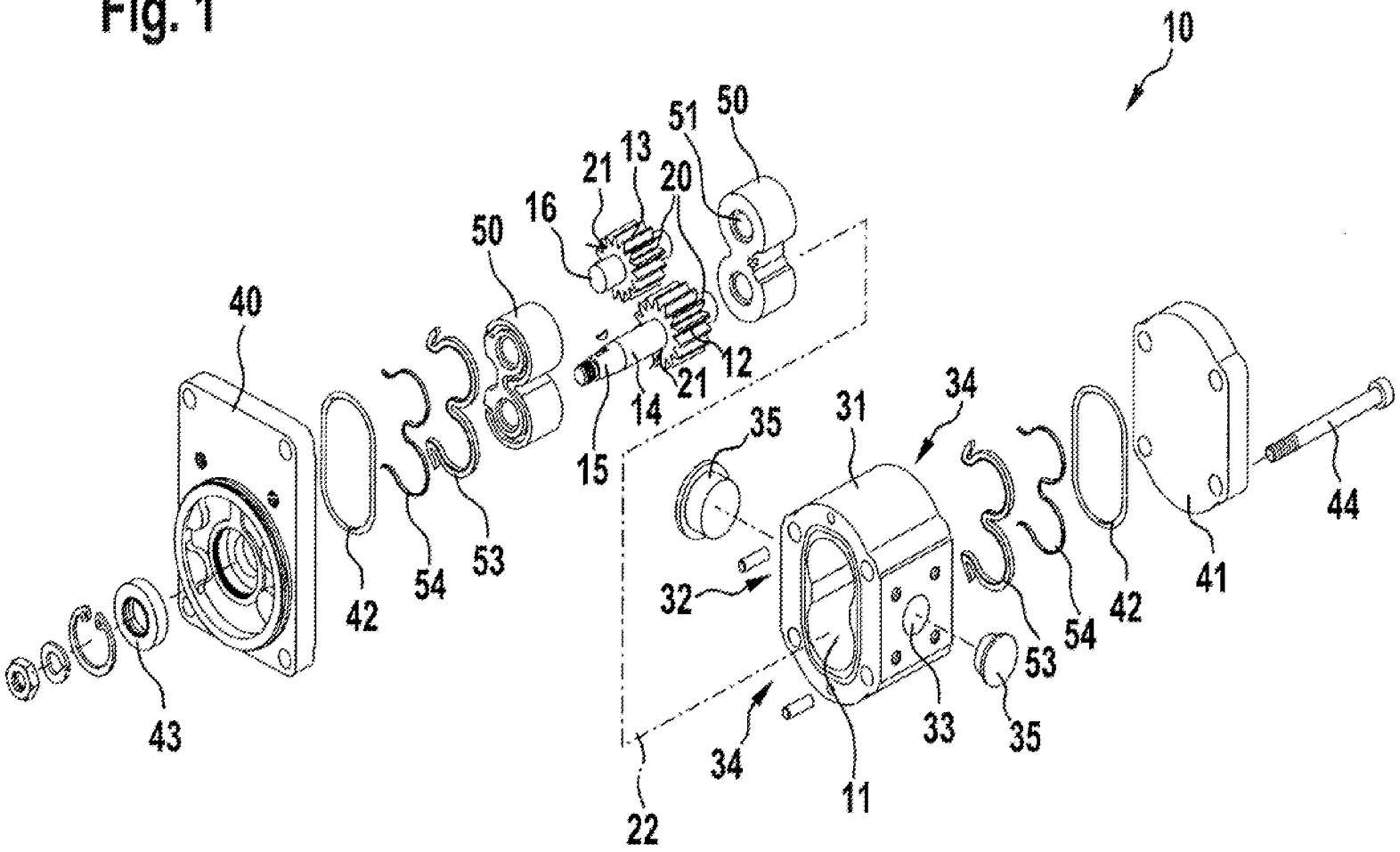
FIG. 1 shows an exploded view of a gear machine according to the disclosure.

FIG. 1 shows an exploded view of a gear machine 10 according to the disclosure. The gear machine 10 comprises a housing 31; 40; 41, which consists of a main body 31, on the two opposite ends 34 of which a first and a second cover 40; 41 are arranged. The parts 31; 40; 41 are held together by four screw bolts 44, of which only one is shown in FIG. 1.

Bearing bodies 50, which are mirror-symmetrical with respect to one another, and two gearwheels 12; 13 are accommodated in the main body 31. The axes of rotation 22 of the gearwheels 12; 13 are parallel to one another. The interior space 11 enclosed by the main body 31 and the two bearing bodies 50 is matched in a substantially fluidtight manner to the gearwheels 12; 13, which mesh with one another in external engagement. In particular, the bearing bodies 50 rest on the mutually opposite flat side faces 21 of the gearwheels 12; 13, wherein the main body 31 rests on the tooth tip diameter of the gearwheels 12; 13.

Gearwheel 12 is formed integrally with a shaft 14, which projects with a drive journal 15 from the housing 31; 40; 41; 50 through the first cover 40. Arranged in the first cover 40 is a radial shaft sealing ring 43, which rests sealingly by means of its sealing lip on the shaft 14, thus preventing any pressurized fluid from escaping there. Respective cover seals 42 in the form of O-rings made of rubber are provided between the main body 31 and the first and second covers 40; 41. The axle 16 and the shaft 14 each form two bearing journals 20, which are rotatably mounted in the two bearing bodies 50, in an associated bearing bore 51. The bearing bore 51 is formed by a separate bearing sleeve to ensure that excessive wear does not occur on the corresponding plain bearings when the gear machine 10 is running at low speed.

Attention should furthermore be drawn to the axial field seal 53 and the associated supporting element 54 on the rear side of the two bearing bodies 50. The axial field seal 53 rests on the associated first or second cover 40; 41. On the opposite side, it rests on the supporting element 54, which, for its part, is pressed against the axial field seal 53 by the pressure at the high pressure port 33. The axial field seal 53 delimits two pressure fields with respect to one another, in which the pressure at the high pressure port 33 and the pressure at the low pressure port 32 respectively act. As a result, the bearing bodies 50, which are accommodated movably in the main body 31, are pressed against the flat side face of the gearwheels 12; 13, thereby ensuring a pressure tight seal.

The low pressure port 32 and the high pressure port 33 are arranged on the main body 31. In the delivery condition illustrated in FIG. 1, they are closed by means of respective separate plugs 35, wherein the low pressure port 32 has the larger diameter and consequently the larger plug 35.

Figure 2:
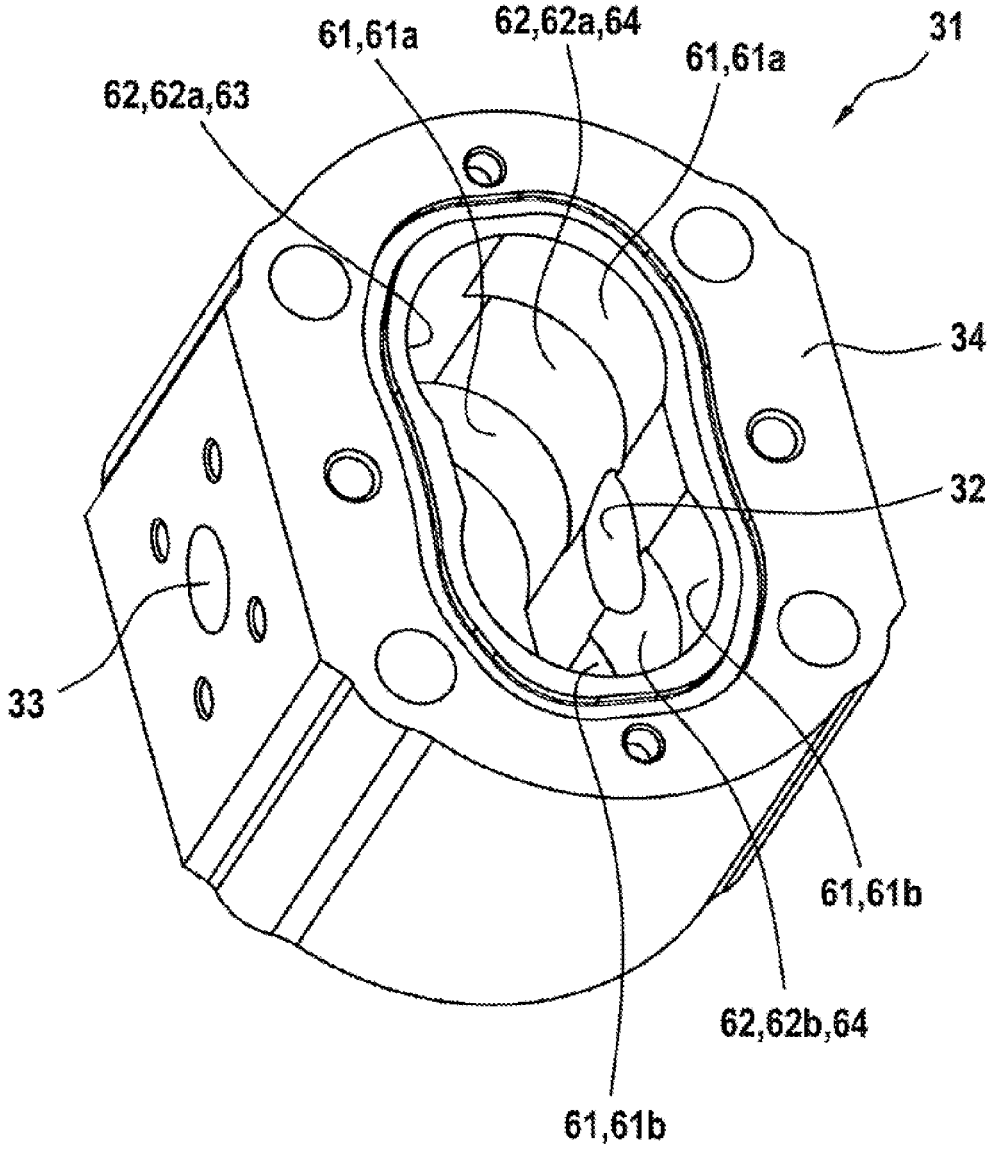
FIG. 2 shows a perspective view of the main body.

FIG. 2 shows a perspective view of the main body 31. The main body 31 is preferably composed of aluminum or grey cast iron, wherein the gearwheels are composed of steel, wherein they are hardened especially in the region of the teeth. Accordingly, the teeth can remove material from the main body 31 during the run-in operation.

Overall, the internal form of the main body 31 has four bearing surfaces 61, namely two first bearing surfaces 61*a*, which are associated with the first gearwheel (No. 12 in FIG. 1) and two second bearing surfaces 61*b*, which are associated with the second gearwheel (No. 13 in FIG. 1). Arranged between two mutually associated bearing surfaces 61 is a respective associated sealing surface 62, which is made up of a first and a second segment 63; 64. The boundaries between the bearing surface 61 and the sealing surface 62 are defined by a plane which is aligned perpendicularly to the axes of rotation of the gearwheels and which coincides with the side faces of the gearwheels and of the bearing bodies. However, it is also possible for said boundaries to be offset somewhat toward the gearwheels in order reliably to avoid leaks.

The first segment 63 of the sealing surface 62 is arranged so as to be flush with the associated bearing surfaces 61, wherein said surfaces are of circular-cylindrical design. In this case, they are matched with very little clearance to the associated circular-cylindrical outer surface segment (No. 60 in FIG. 3) of the bearing body, thus allowing the bearing body to move in the direction of the axes of rotation of the gearwheels but not radially with respect thereto.

The second segment 64 of the sealing surface 62 is likewise of circular-cylindrical design, wherein the central axis of the second segment 64 is arranged eccentrically with respect to the central axis of the associated bearing surface 61. Here, the offset is toward the low pressure port 32, preferably along the line indicated by No. 65 in FIG. 3. It is in the second segment 64 of the sealing region 62 that most of the removal of material takes place during the run-in operation, while the first segment 63 remains substantially unaffected. Owing to production tolerances, however, removal of material may also occur in the first segment.

Figure 3:
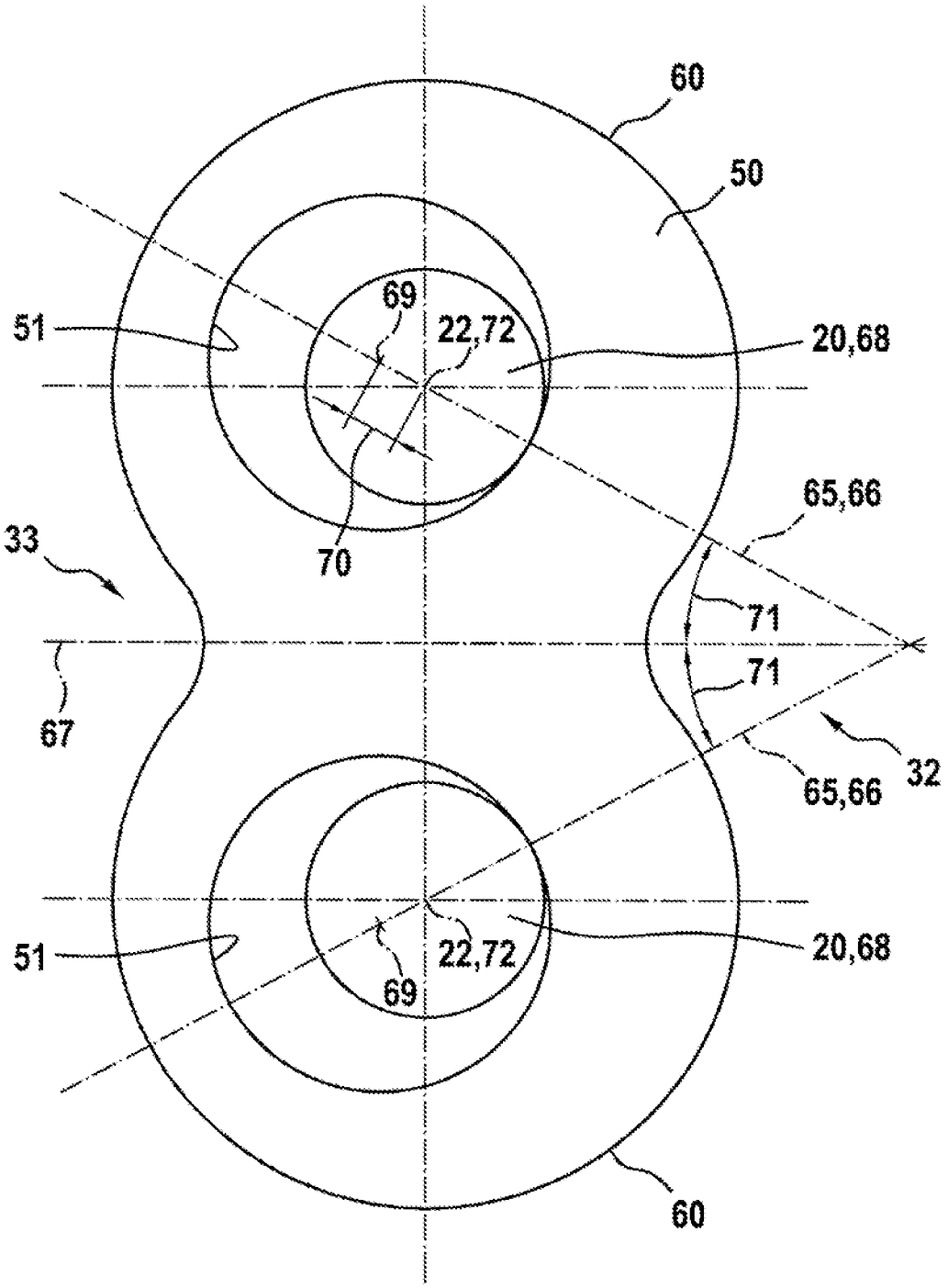
FIG. 3 shows a rough schematic side view of the bearing body.

FIG. 3 shows a rough schematic side view of the bearing body 50, wherein the gap between the bearing bore 51 and the bearing journals 20, in particular, is shown in an exaggerated way. It illustrates an integral bearing body 50 of the kind also shown in FIG. 1. However, the present disclosure can also be used for two-part bearing bodies 50, which preferably rest one upon the other in a parting plane which coincides with the plane of symmetry 67.

Hydraulic gear machines in a pressure range above about 50 to 100 bar are subject to a run-in process. During this process, the tooth tip circle, which is deliberately manufactured to be slightly "too large", cuts into the pump housing by a certain amount the first time the pump is operated under pressure. This brings about compensation of the tolerances involved in the sealing of the tooth tip with respect to the housing, namely the diameter of the bearing journal, of the bearing bore, of the tooth tip diameter and of the outer surface segment 60 of the bearing body 50 to the extent that each gear machine receives its own individual zero gap at the tooth tip (at operating pressure) during run-in. The run-in zone formed in the housing spans several tooth tips of the gearwheel in the pressurized operating state and thus ensures good tooth tip sealing with respect to the housing. This results in good volumetric efficiency in the pressurized operating state.

However, the run-in process takes time and produces swarf, which has to be flushed out of the pump in an expensive process. Moreover, swarf may remain in the pump despite flushing, may be released in the customer's system and may cause damage there. The variation in the depth of the run-in zone in individual instances is essentially determined by the sum of the tolerances mentioned. In order to provide good tooth tip sealing, namely a sufficiently deep run-in zone which includes enough tooth tips, for each tolerance combination which occurs in manufacture, the run-in depth and also the variation therein in proportion to the sum of said tolerances is consequently quite large. This prolongs the required run-in time and increases the amount of run-in swarf produced.

A small total tolerance is therefore the aim. It is usually the diameter of the bearing bore 51 which makes by far the largest contribution to the tolerances (as much as 50% and above). This is attributable to the fact that the bearing bore 51 is usually formed on a separate bearing sleeve, which is press fitted into the remainder of the bearing body 50.

According to the disclosure, the operating position of the subsequent bearing journal 20 within the bearing bore 51 is simulated by means of a mandrel 68 during the removal of material from the circular-cylindrical outer surface segment 60 of the bearing body 50. The mandrel 68 makes contact within the bearing bore 51 at an angle 71 of 30° corresponding to the position of the bearing journal 20 during actual operation of the gear machine. As a result, the diameter tolerance of the bearing journal 20 no longer contributes to the required run-in depth but lies completely on the side of the bearing bore 51 which is 180° opposite to the run-in zone.

The center 72 of the outer surface segment 60 of the bearing body 50 is thus positioned eccentrically with respect to the center 69 of the bearing bore 51, the eccentricity being indicated by the No. 70. Said centers 72 and 69 are situated on the line 65 of the direction of force 66 on the gearwheel (e.g. 30°+/−15°. The principal can be applied equally to one- and two-part bearing bodies 50.

LIST OF REFERENCE SIGNS

10 gear machine
11 interior space
12 first gearwheel
13 second gearwheel
14 shaft
15 drive journal
16 axis
20 bearing journal
21 side faces of a gearwheel
22 axis of rotation
31 main body
32 low pressure port
33 high pressure port
34 end
35 plug
40 first cover
41 second cover
42 cover seal
43 radial shaft sealing ring
44 screw bolt
50 bearing body
51 bearing bore
53 axial field seal
54 supporting element
55 axial field groove
56 end face
60 outer surface segment
61 bearing surface
61*a* first bearing surface
61*b* second bearing surface
62 sealing surface
62*a* first sealing surface
62*b* second sealing surface
63 first segment of the sealing surface
64 second segment of the sealing surface
65 direction of the eccentricity
66 direction of the operating force
67 plane of symmetry
68 mandrel
69 center of the bearing bore
70 eccentricity of the bearing bore
71 angle
72 center of the outer surface segment

What is claimed is:

1. A gear machine, comprising:

a housing;

at least two gearwheels positioned within the housing, the at least two gearwheels configured to mesh in external engagement with each other; and a bearing body defining a circular-cylindrical outer surface segment and a bearing bore;

wherein:

at least one of the at least two gearwheels includes at least one bearing journal rotatably positioned within the bearing bore;

the bearing body is positioned within the housing with the circular-cylindrical outer surface segment engaging a corresponding bearing surface defined on the inside of the housing;

each of the at least two gearwheels includes a plurality of tooth tips configured to engage a corresponding sealing surface defined on the inside of the housing;

at least one segment of at least one of the sealing surface and the bearing bore is eccentric with respect to the circular-cylindrical outer surface segment of the bearing body; and the sealing surface includes a first segment that is flush with the bearing surface and a second segment having a circular-cylindrical shape arranged eccentrically with respect to the bearing surface.

2. The gear machine according to claim 1, wherein:

the at least two gearwheels comprises a first gear wheel and a second gearwheel;

the first gear wheel is configured to engage a first sealing surface defined on the inside of the housing;

the second gear wheel is configured to engage a second sealing surface defined on the inside of the housing, the second sealing surface configured similar to the first sealing surface to include a first segment and a second segment; and the second segment of the first sealing surface has at least one of a different diameter and a different eccentricity than the second segment of the second sealing surface.

3. The gear machine according to claim 1, wherein an entire circumference of the bearing bore has a circular-cylindrical shape that is eccentric with respect to the circular-cylindrical outer surface segment of the bearing body.

4. The gear machine according to claim 3, wherein an eccentricity of the bearing bore with respect to the circular-cylindrical outer surface segment of the bearing body is configured such that an axis of rotation of the at least one of the at least two gearwheels is centric with respect to a corresponding bearing surface during the operation of the gear machine.

5. The gear machine according to claim 1, wherein a selected direction of the eccentricity is parallel to a direction of a force that a pressurized fluid is configured to exert on a respective gearwheel during operation.

6. The gear machine according to claim 5, wherein:

the at least two gearwheels comprises a first gear wheel and a second gearwheel that are each positioned symmetrically in relation to a plane of symmetry; and the direction of the eccentricity is at an angle of between 15° and 45° with respect to the plane of symmetry.

7. The gear machine of claim 6, wherein the direction of the eccentricity is at an angle of 30°.

8. The gear machine of claim 1, wherein the gear machine is configured as a gear pump.

9. The gear machine of claim 1, wherein the gear machine is configured as a gear motor.

10. A method for producing a gear machine that includes (i) a housing, (ii) at least two gearwheels positioned within the housing, the at least two gearwheels configured to mesh in external engagement with each other, (iii) a bearing body defining a circular-cylindrical outer surface segment and a bearing bore, wherein (a) at least one of the at least two gearwheels includes at least one bearing journal rotatably positioned within the bearing bore, (b) the bearing body is positioned within the housing with the circular-cylindrical outer surface segment engaging a corresponding bearing surface defined on the inside of the housing, (c) each of the at least two gearwheels includes a plurality of tooth tips configured to engage a corresponding sealing surface defined on the inside of the housing, and (d) at least one segment of at least one of the sealing surface and the bearing bore is eccentric with respect to the circular-cylindrical outer surface segment of the bearing body, the method comprising performing a run-in operation including the steps of:

(i) filling the gear machine with pressurized fluid;

(ii) running the gear machine at a predetermined operating pressure of the pressurized fluid; and (iii) selecting an eccentricity such that material of the sealing surface is removed by at least one of the at least two gearwheels.

11. The method according to claim 10, further comprising:

forming the bearing bore in the bearing body;

after forming the bearing bore, forming the circular-cylindrical outer surface segment of the bearing body; and while the circular-cylindrical outer surface segment is formed, mounting the bearing body on a mandrel that engages in the bearing bore.

12. The method according to claim 11, further comprising:

during the production of the circular-cylindrical outer surface segment, clamping the bearing body against the mandrel in a direction of a force which the pressurized fluid exerts on the at least two gearwheels during the operation of the gear machine.

13. A gear machine, comprising:

a housing;

at least two gearwheels positioned within the housing, the at least two gearwheels configured to mesh in external engagement with each other; and a bearing body defining a circular-cylindrical outer surface segment and a bearing bore;

wherein:

at least one of the at least two gearwheels includes at least one bearing journal rotatably positioned within the bearing bore;

the bearing body is positioned within the housing with the circular-cylindrical outer surface segment engaging a corresponding bearing surface defined on the inside of the housing;

each of the at least two gearwheels includes a plurality of tooth tips configured to engage a corresponding sealing surface defined on the inside of the housing;

at least one segment of at least one of the sealing surface and the bearing bore is eccentric with respect to the circular-cylindrical outer surface segment of the bearing body;

a selected direction of the eccentricity is parallel to a direction of a force that a pressurized fluid is configured to exert on a respective gearwheel during operation;

the at least two gearwheels comprises a first gear wheel and a second gearwheel that are each positioned symmetrically in relation to a plane of symmetry; and the direction of the eccentricity is at an angle of 30° with respect to the plane of symmetry.

14. The gear machine according to claim 13, wherein:

the first gear wheel is configured to engage a first sealing surface defined on the inside of the housing;

the second gear wheel is configured to engage a second sealing surface defined on the inside of the housing, the second sealing surface configured similar to the first sealing surface to include a first segment and a second segment; and the second segment of the first sealing surface has at least one of a different diameter and a different eccentricity than the second segment of the second sealing surface.

15. The gear machine according to claim 13, wherein an entire circumference of the bearing bore has a circular-cylindrical shape that is eccentric with respect to the circular-cylindrical outer surface segment of the bearing body.

16. The gear machine according to claim 15, wherein an eccentricity of the bearing bore with respect to the circular-cylindrical outer surface segment of the bearing body is configured such that an axis of rotation of the at least one of the at least two gearwheels is centric with respect to a corresponding bearing surface during the operation of the gear machine.

17. The gear machine of claim 13, wherein the gear machine is configured as a gear pump.

18. The gear machine of claim 13, wherein the gear machine is configured as a gear motor.

* * * * *